United States Patent [19]

Hudson

[11] 4,402,507

[45] Sep. 6, 1983

[54] BALL-TOSSING DEVICE

[76] Inventor: Robert H. Hudson, 103 Valley St., Seekonk, Mass. 02771

[21] Appl. No.: 202,647

[22] Filed: Oct. 31, 1980

[51] Int. Cl.[3] ..... A63B 69/40

[52] U.S. Cl. ..... 273/26 R; 124/16; 124/10; 124/36

[58] Field of Search ..... 273/26 R, 26 D, 399; 124/7, 79, 80, 81, 1, 45, 47, 51 R, 82, 16, 34, 36, 38

[56] References Cited

U.S. PATENT DOCUMENTS

| | | | |
|---|---|---|---|
| 379,913 | 3/1888 | Stockton | 124/10 |
| 1,777,976 | 10/1930 | Lacoste | 273/26 D |
| 2,279,766 | 4/1942 | Truesdell | 124/16 |
| 2,545,358 | 3/1951 | Jenkins | 124/36 |
| 2,705,003 | 3/1955 | Schensted | 273/26 R |
| 2,722,211 | 11/1955 | Eisele | 124/16 |
| 2,860,621 | 11/1958 | Blackadder | 124/17 |
| 3,080,859 | 3/1963 | Benkoe | 273/26 R |
| 3,368,541 | 2/1968 | Bink | 124/7 |
| 3,394,691 | 7/1968 | Brink | 124/7 |
| 3,481,605 | 12/1969 | Giraud et al. | 124/36 |
| 3,612,027 | 10/1971 | Makino | 273/26 R |
| 3,627,319 | 12/1971 | Skyhawk | 124/34 |
| 3,794,325 | 2/1974 | Stender | 124/7 |
| 3,856,300 | 12/1974 | Payne | 273/26 R |

*Primary Examiner*—Richard C. Pinkham
*Assistant Examiner*—T. Brown
*Attorney, Agent, or Firm*—Barlow & Barlow Ltd.

[57] ABSTRACT

A ball-tossing device is disclosed that has a batting practice member that is mechanically coupled to a foot treadle plate that is pivoted on a base member. The arrangement is such that pressure on the foot treadle plate spring-loads the ball-tossing member, and continued movement of the foot treadle plate causes the ball-tossing member to quickly move the ball in an upward direction. A spring means is provided to return the foot treadle plate to a normal rest position that in turn, returns the ball-tossing member to a rest position.

3 Claims, 6 Drawing Figures

BALL-TOSSING DEVICE

BACKGROUND OF THE INVENTION

This invention relates generally to a ball-tossing device and more particularly to a device that is adapted for baseball batting practice and may be operated by the user. Various ball-tossing devices are known in the prior art. In general the user steps on something to trigger or otherwise cause the release of the ball for batting. In most cases, as for example, In U.S. Pat. Nos. 3,394,691, 3,794,325 and 3,545,752 a spring device is cocked and the ball is suitably loaded on the cocked spring device, the user stepping on a member which causes release of a latch and in turn the upward movement of the ball. Arrangements such as this have to be cocked everytime they need to be used, which means that the user must stoop down and suitably re-set the device after each use.

SUMMARY OF THE INVENTION

One of the objects of the present invention is to provide a batting practice device that is easily portable and simple to operate. A more specific object of the invention is to provide a device in the form of a ball-tossing mechanism wherein the tossing mechanism itself is employed as a spring mechanism which is both cocked and released by a simple downward pressure of the user's foot.

A centrally pivoted flexible arm is suitably mounted on a base which has a foot location at one end thereof and a ball-receiving location at the other end. A ball is positioned at the ball-receiving end and the user can push downwardly at the opposite end in order to cock the device. Latching means are provided at the ball-receiving end which will hold the device cocked until sufficient spring force exists at which time the latch releases and the ball is tossed into air at the proper height for batting.

DESCRIPTION OF THE PREFERRED EMBODIMENT

Figure 1:
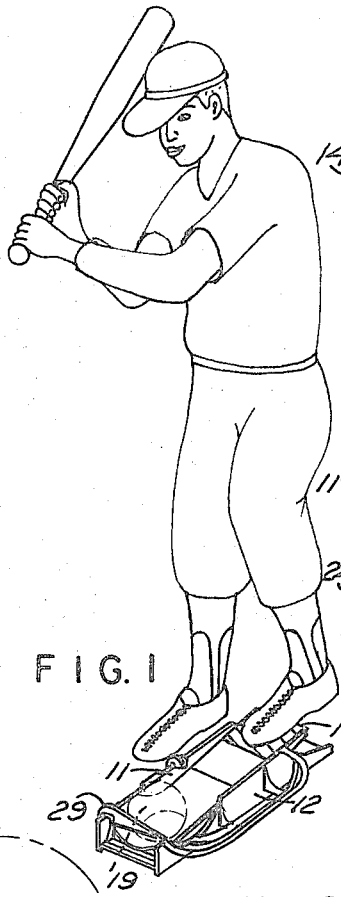
FIG. 1 is a perspective view showing how the invention is operated.
Figure 4:
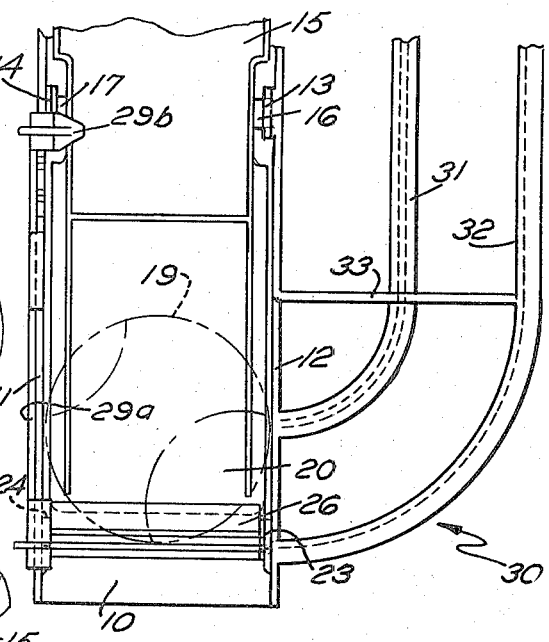
FIG. 4 is a partial top plan view thereof.

An embodiment of the batting practice device illustrated in FIGS. 1 to 6 ofthe drawings includes a base 10 in the form of an elongated flat plate that has rising therefrom a pair of upstanding walls 11 and 12 which walls each carry a pivot socket 13 and 14 respectively. Overlying the elongated flat plate base is a foot treadle 15 which is of generally elongated shape and is disposed along its length generally parallel to the longitudinal extent of the base. The foot treadle carries a pair of pivot pins 16 and 17 and engage respectively the pivot sockets 13 and 14. Rising from the base is a spring member 18 in the form of a flat plate-like member which generally urges the foot treadle member 15 upwardly as viewed in the drawing.

A bendable ball-tossing member 20 is seen as an extension of the foot treadle and integral therewith. A ball 19 rests on member 20. On either side of the base member 10 adjacent the end 21 of the ball-tossing member are a pair of posts 23, 24 that carry for rocking movement therebetween a block 26. The block 26 is generally wedge-shaped with trunions 28 extending from either end thereof that rockably engage the posts 23, 24. The wedge-shaped block 26 and the position of the posts is such that when the ball-tossing member has its end 21 depressed below the wedge-shaped member 26, the wedge-shaped member will normally swing so that a portion thereof engages the edge 21 of the ball-tossing member.

Figure 2:
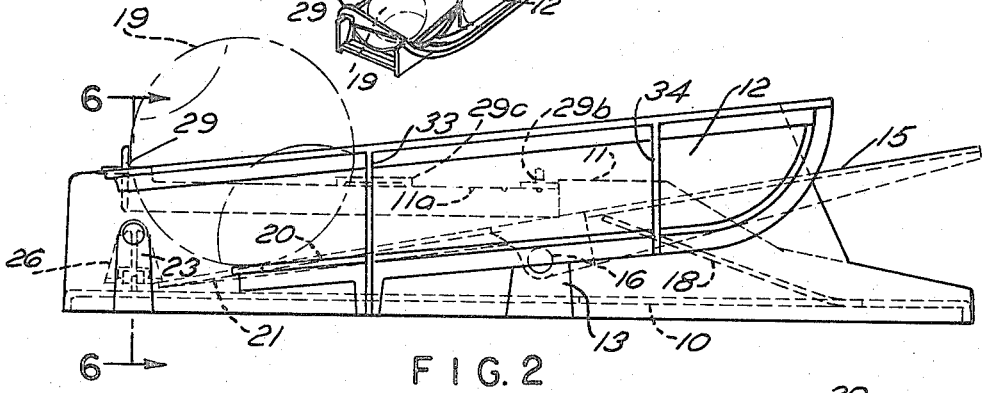
FIG. 2 is a side elevational view of one form of the invention.
Figure 3:
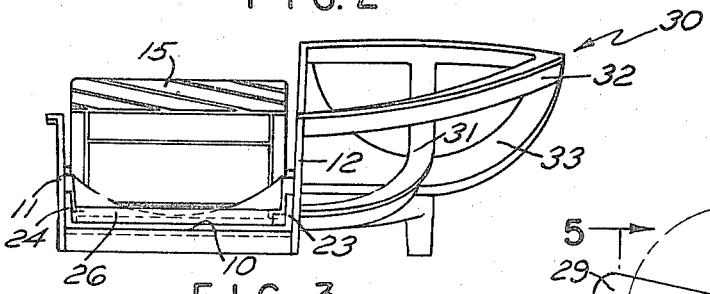
FIG. 3 is an end view taken from the lefthand side of FIG. 2.
Figure 5:
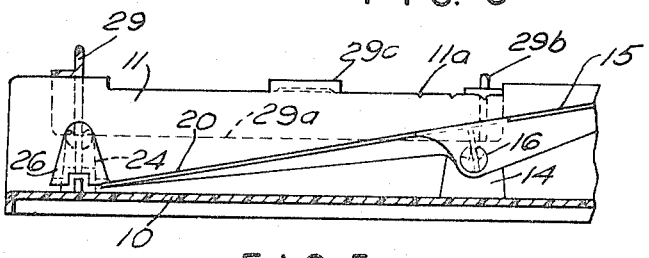
FIG. 5 is a partial elevational view with the feed chute removed showing the latching mechanism.
Figure 6:
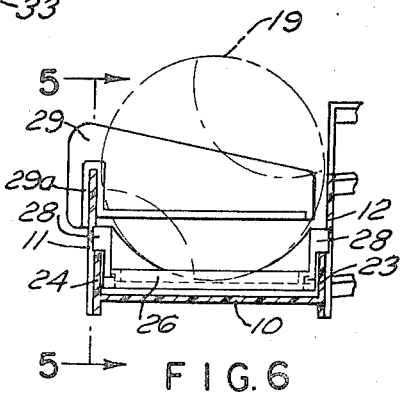
FIG. 6 is a sectional view taken on 6—6 of FIG. 2.
Figure 7:
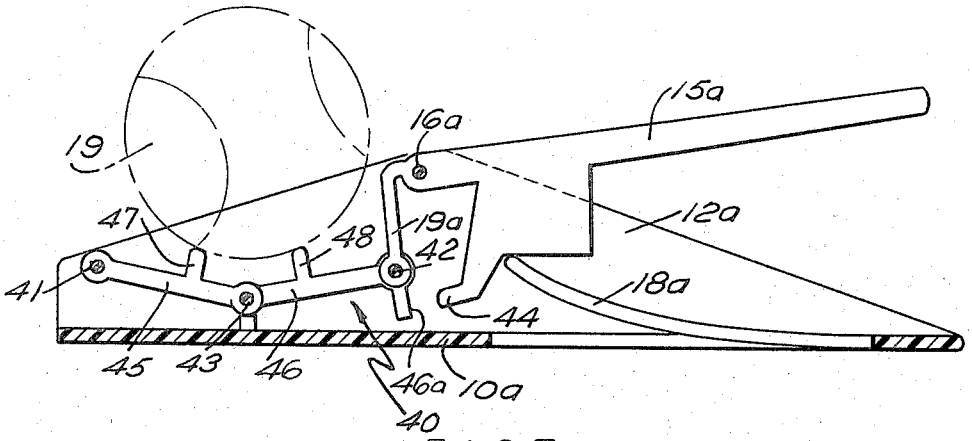
Figure 8:
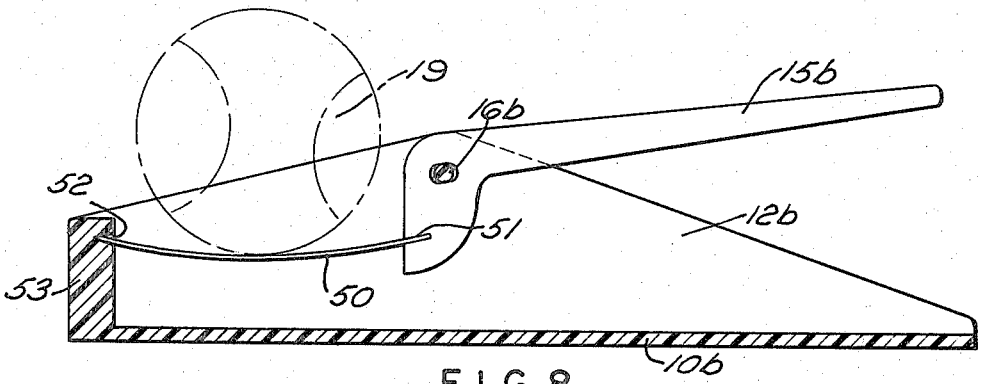
Figure 9:
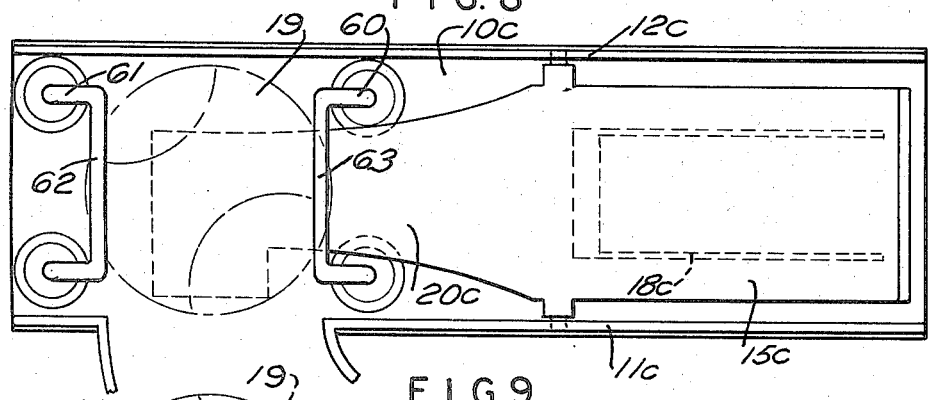
Figure 10:
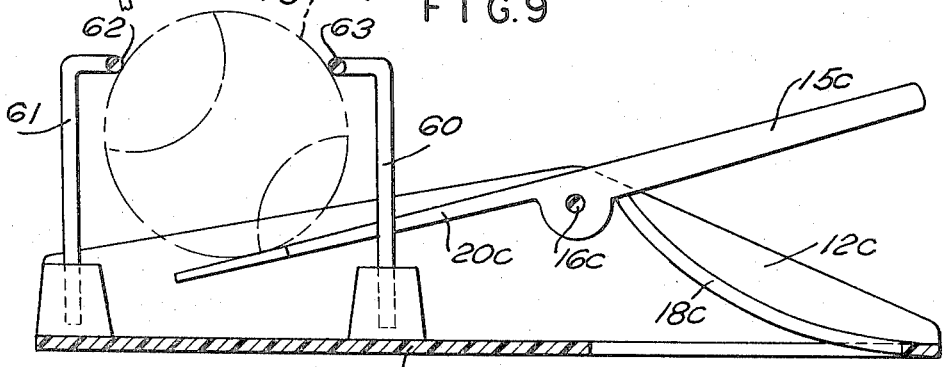

From the description as far as it has proceeded, it will now become apparent that as the foot treadle 15 has pressure exerted thereon that the ball-tossing member 20 will bend under a spring force, and as the plane of the ball-tossing member is above pivot 16, the member 20 moves a small distance to the right as the treadle is pressed. This small movement pulls end 21 from under wedge 26 or latch and inasmuch as the ball-tossing member 20 has now been elastically deformed or stressed into an extended leaf spring, that spring action will toss the ball 19 that is placed on the ball-tossing member into the air. It will also be apparent that after the ball has been tossed, that spring 18 will urge the treadle 15 upwardly again and in turn the ball-tossing member 20 will move downwardly and return to its at-rest position as seen in FIG. 2, rocking the wedge member 26 as the edge 11 of the ball-tossing member passes downwardly. In this fashion it will be apparent that the cocking movement is automatic and need not be made as a separate action between each play.

To control the position of the ball 19 as it lies on the tossing member 20, a positioning stop 29 is provided which is essentially a plate-like member (see FIG. 6), with a slot cut therein to ride on the upper edge of wall 11. The position of this member 29 is controlled by an arm *29a* that extends parallel to the side wall 11 and is held in position by a tab *29c*. The arm terminates in a handle member *29b* that has a depending protrusion that will selectively engage a plurality of notches such as the notch *11a*. The arrangement is such that as the position of the ball is changed relative to the pivot point between the treadle 15 and the ball-tossing member 20, the amount of action or leverage exerted upon the ball 19 will vary and thus in its most forward position near the end of the ball-tossing member 20, the ball 19 will fly further in the air.

In order to continue play action a feed chute may be provided. The chute being designated generally 30 and being mounted (FIG. 4) to one side of the longitudinal extent of the base 10. As seen in the drawings, the chute may comprise simply a pair of rails 31, 32 (FIG. 4) that are suitably joined together in a structural form as by means of semi-circular rib portions 33, 34 (FIG. 2). The chute 30 is generally inclined as seen in FIG. 2, and as will be appreciated will automatically feed a ball into position if there be no obstruction. The balls are retained in position over the ball-tossing member and are readily retained in position as the side wall 11 rising from the base maintains the ball from being dislodged off the ball-tossing member.

As will be apparent from the above, the ball is tossed upwardly abruptly by the ball-tossing arm and, there is a resilient return member such as the spring 18 that returns the mechanism to an at-rest and automatically re-cocked position. The ball-tossing member exerts sufficient force to toss the ball at a sufficient height so that the batter may swing at the ball. It is an important aspect of the invention that continued pressure of one's foot on the device is used to toss the ball in an upward direction by the mechanism. There is no sudden jerk necessary or other unusual movement that is different from that that is normal to batting in a usual ball game. Increased pressure on the foot treadle as would occur by a batter lunging toward the ball once it has been released does not damage the device in any way and the simplicity of the action can be readily appreciated by the foregoing description and taken in conjunction with the appended claims.

I claim:

1. A batting practice device including a ball tossing means, said ball tossing means having a pivoted plate with a foot-contacting surface at one end and a ball contacting surface at the other end thereof, a pivoted pawl, said pawl engaging the said other end of the plate, resilient means urging the foot-contacting end upwardly, downward pressure exerted by the foot of a user on the foot-contacting surface of said plate initially stressing and then subsequently releasing the said other end from said pawl to cause said other end to quickly move in an upward direction to toss a ball, means re-setting the ball tossing means whereby removal of the foot of the user allows said resilient means to effect reverse movement of said pivoted plate said other end of the plate swinging the pawl to allow the end to be captured by the pawl whereby the ball tossing means is reset.

2. A batting practice device as in claim 1 wherein means are provided to position a ball on the said other end of said plate.

3. A batting practice device as in claim 1 including a ball feeding chute to deliver balls to the said other end of said plate.

* * * * *